United States Patent [19]

Nussbaumer

[11] 4,165,886

[45] Aug. 28, 1979

[54] CROSS COUNTRY SKI

[75] Inventor: Wolfgang Nussbaumer, Dornbirn, Austria

[73] Assignee: Kastle Gesellschaft m.b.H., Hohenems, Austria

[21] Appl. No.: 872,461

[22] Filed: Jan. 25, 1978

[30] Foreign Application Priority Data

Feb. 4, 1977 [AT] Austria ..... 711/77

[51] Int. Cl.[2] ..... A63C 7/06

[52] U.S. Cl. ..... 280/604; 280/610

[58] Field of Search ..... 280/604, 601, 608, 609, 280/610

[56] References Cited

U.S. PATENT DOCUMENTS

| | | | |
|---|---|---|---|
| 2,694,580 | 11/1954 | Head | 280/610 |
| 3,980,312 | 9/1976 | Buttner | 280/604 X |

FOREIGN PATENT DOCUMENTS

| | | | |
|---|---|---|---|
| 2110737 | 8/1972 | Fed. Rep. of Germany | 280/604 |
| 2219383 | 11/1973 | Fed. Rep. of Germany | 280/604 |
| 2516584 | 10/1976 | Fed. Rep. of Germany | 280/604 |
| 390760 | 8/1965 | Switzerland | 280/610 |

*Primary Examiner*—Joseph F. Peters, Jr.
*Assistant Examiner*—Milton L. Smith
*Attorney, Agent, or Firm*—Haseltine, Lake & Waters

[57] ABSTRACT

A cross-country ski having at least one recess in the sliding surface for an interchangeable insert. One surface of the insert is advantageously self-adhesive and the other is preferably provided with a construction to prevent backward-sliding. Between the sliding sole and the lowest layer of the body of the ski an intermediate layer is provided, and the recesses for the insert extend into the intermediate layer whereby the insert is bonded to the intermediate layer.

9 Claims, 5 Drawing Figures

CROSS COUNTRY SKI

BACKGROUND OF THE INVENTION

1. Field of the Invention

The invention relates to a cross-country ski having preferably in its central portion in respect to the length of the ski at least one recess in the sliding surface for at least one interchangeable insert, wherein one surface of said insert is advantageously self-adhesive and the other is preferably provided with means to prevent backward sliding.

2. Description of the Prior Art

Inserts for skis of this type normally comprise several layers, e.g. one layer comprising the means to prevent backward sliding (steps, scales, skin) on the side of the sliding surface, a supporting web, to which the above-mentioned layer is bonded and a band that is adhesive on both of its sides, one side being integrally joined to the supporting web, the other being the self-adhesive surface of the insert. As such an insert is of considerable thickness, a corresponding depth of the recess in the sliding sole of the ski is necessary. In order to achieve this, relatively thick sliding soles must be used, which in the case of cross-country skis is a disadvantage for weight-reasons and/or the cost of the high-quality material for sliding soles. Otherwise, the recesses must extend into the body of the ski, thus impairing the supporting function of the lowest layer of the ski-body, on the one hand and causing problems in the production, on the other hand, as considerable tool-wear is entailed when milling into the lowest supporting layer of the ski, which in the case of modern skis, is almost exclusively made of glass reinforced plastics. It is a further disadvantage that the sliding soles are conventionally produced of materials with poor adhesive qualities, e.g. polyethylene, so that the inserts are not sufficiently affixed to the recesses in such a sliding surface of polyethylene.

SUMMARY OF THE INVENTION

An object of the present invention is to obviate the above disadvantages and to improve the adhesive qualities of the recesses in the sliding surfaces of skis of the above-mentioned type for receiving preferably interchangeable inserts.

According to the invention, this is achieved by providing between the sliding sole and the lowest layer of the body of the ski, preferably of glass fiber reinforced plastics, at least one intermediate layer, the recess for the insert extending through the sliding surface and into the intermediate layer, but preferably not penetrating this layer to its full depth.

According to the invention sliding surfaces of reduced thickness can be used. Furthermore, a material for the intermediate layer according to the invention can be chosen that avoids excessive tool-wear in the manufacturing process, on the one hand, and provides excellent adhesion of the interchangeable and preferably self-adhesive inserts. Hence, adhesion should meet the requirements of the practical use of the ski and at the same time not hinder the desired interchange of the inserts or cause damage to the insert or to the surface of the recesses. Thus, in the case of e.g. a polyethylene sliding surface it is of advantage to provide an intermediate layer according to the invention of an ABS-polymer, to which adhesion of the (self)-adhesive side of the insert is much higher than to polyethylene. At the same time the insert can easily be removed.

Any adhesive can be used allowing a dissolving of the adhesive joint, e.g. a polyisoprene-adhesive or any adhesive based on low-molecular polyisobutylene.

As the recesses provided for the interchangeable inserts do not necessarily extend over the entire length of the ski, the intermediate layer according to the invention preferably only extends substantially over that portion of the ski where the recesses are provided. As compared to a continuous intermediate layer a considerable reduction of the weight of the ski is thus achieved. It is of special advantage to provide the recesses only in the central portion of the ski in order to limit the intermediate layer to said central portion of the ski. In order to avoid irregularities in the build-up of the layers of the ski in the case of an intermediate layer that is shorter than the ski, it is advantageous to taper the front and rear portions of the intermediate layer at least in their height (and thickness).

BRIEF DESCRIPTION OF THE DRAWING

In the following an embodiment of the invention will be described in more detail with reference to the attached drawing without being limited thereto.

DESCRIPTION OF THE PREFERRED EMBODIMENT

Figures 1, 2, 3:
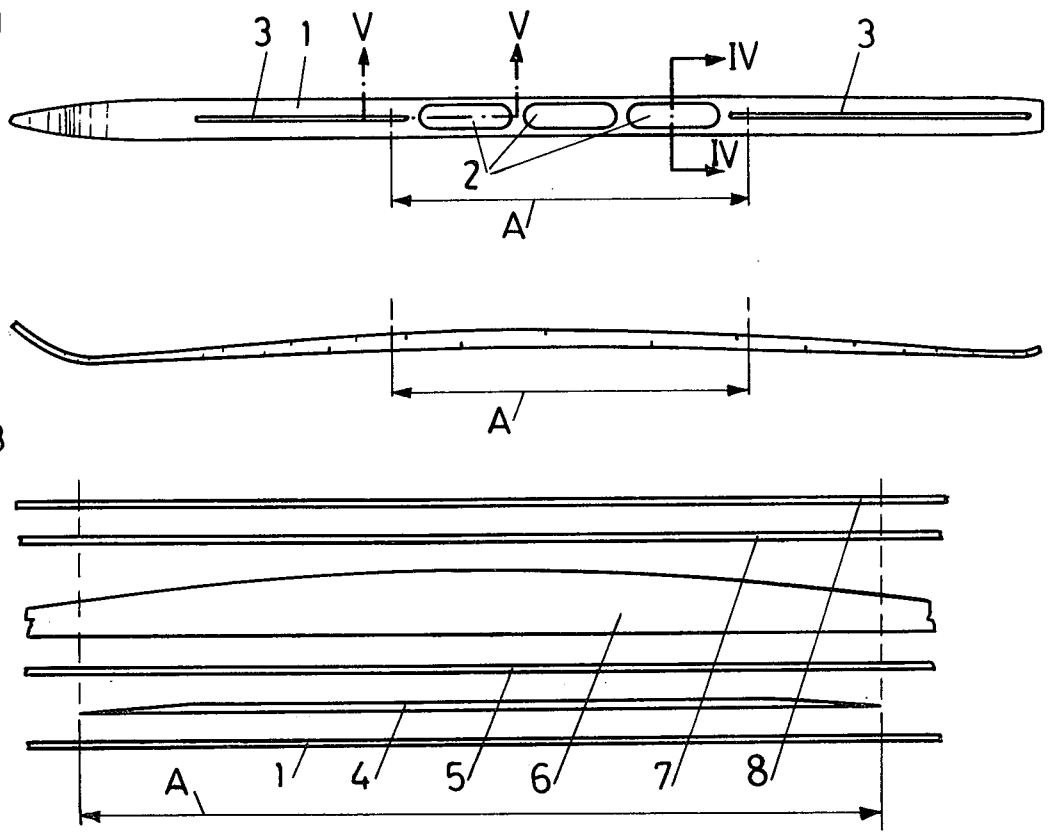
FIG. 1 is a plan view of the sliding surface of a cross-country ski.
FIG. 2 is a side view thereof.
FIG. 3 is an exploded side view of the layers forming the ski.

In the described embodiment the sliding surface of the ski is formed partly by the sliding sole 1 and partly by inserts 2 which are interchangeably affixed in recesses in the sliding surface. The recesses and inserts 2 extend only in the central portion of the ski. In front of and behind the inserts 2 a guide groove 3 is provided in the sliding surface. According to the build-up of layers, as shown in FIG. 3, the ski according to the embodiment consists of (from bottom to top) the sliding sole 1 of polyethylene, an intermediate layer 4 of ABS-polymer extending over a central portion A only, the lower supporting layer 5 of glass fiber reinforced plastic, a core 6 of light weight material (e.g. poplar wood, foamed polyurethane), an upper supporting layer 7 of glass fiber reinforced plastic and a top coating 8 of ABS-polymer.

Figure 4:
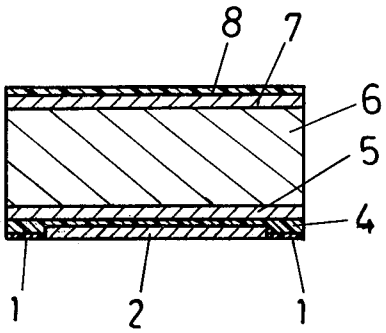
FIG. 4 is a sectional view taken along line IV—IV in FIG. 1.
Figure 5:
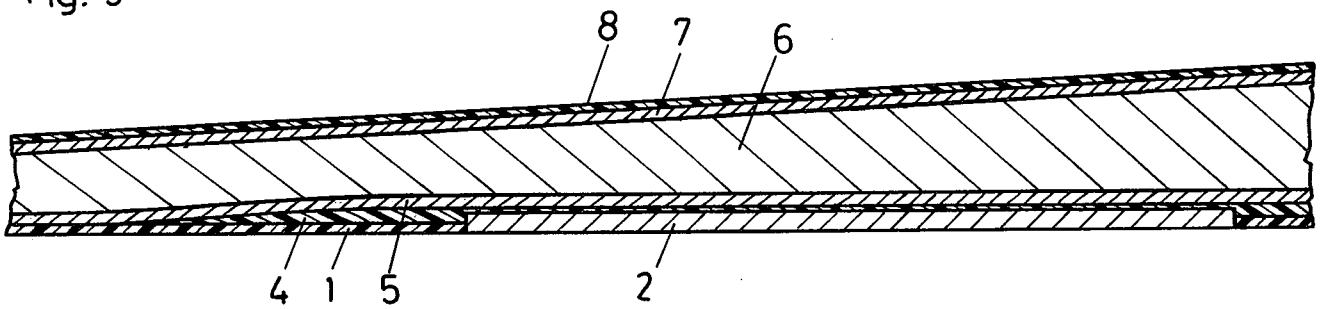
FIG. 5 is a lengthwise sectional view taken along line V—V in FIG. 1.

After bonding and pressing the layers according to FIG. 3 together the recesses for inserts 2 are milled into the central portion of the ski. As seen in FIGS. 4 and 5 the recesses penetrate the sliding sole 1 and extend into the intermediate layer 4 without, however, penetrating to the full depth of layer 4. Thus, the recesses are deeper than the thickness of the sliding sole and have a bounding surface of the ABS of layer 4. The thickness of the inserts 2 corresponds to the depth of the recesses. The milling-depth of the intermediate layer depends on the thickness of the inserts 2 and the thickness of the sliding sole 1. In the case of thinner inserts 2 it may be sufficient to extend the recesses only slightly into the intermediate layer 4 so that the face of the intermediate layer 4 forming the basic face of the recesses is only very slightly milled or ground away. The inserts 2 have self-adhesive backs which are removably affixed to the ABS-basic face of the recesses. The side of the inserts 2 forming part of the sliding surface can be provided with means in order to prevent backward sliding (e.g. steps, scales, skin). It is, however, possible to affix inserts with smooth, polished or pre-waxed surfaces according to snow-conditions and sporting requirements.

Length A of intermediate layer 4 in the central portion of the ski according to FIG. 1 substantially corresponds to the total length of the recesses for the inserts. FIGS. 3 and 4 show that the intermediate layer 4 is tapered at its front and rear portions.

For the intermediate layer, according to the invention, other materials than the above-mentioned ABS-polymer can be used, particularly other thermoplastic or thermosetting plastics as well as light weight metals, wood or the like, preferably materials of low specific weight. The inserts 2 and the corresponding recesses can, however, have different shapes and number and be disposed over the sliding surface of the ski in a different manner. Instead of one broad insert 2, two narrower inserts can be provided (e.g. on either side of a continuous guide groove).

The described embodiment having several (in this case three) recesses disposed one after the other and one intermediate layer 4 extending over the total length of the recesses is certainly of advantage. In the case of several recesses, it is, however, possible to place separate intermediate layers under each recess or under a separate group of recesses, thus providing several intermediate layers either one behind the other or one beside the other.

What is claimed is:

1. A cross-country ski comprising a supporting ski body including a plurality of superposed layers and a sliding sole, said sole being provided with a recess, and an interchangeable insert adhesively secured in said recess in said sole, said insert having an outer surface directed towards the snow which is provided with means to prevent backward sliding of the ski, at least one intermediate layer being interposed between and secured to the sliding sole and the lower surface of the superposed layers of the supporting ski body, said recess extending completely through said sliding sole and partially into said intermediate layer such that the depth of the recess is less than the sum of the thickness of said sliding sole and said intermediate layer, said intermediate layer being constituted of a material to which the adhesive joining the insert in said recess provides better adhesion as compared to the adhesion with the material of the sliding sole.

2. A cross-country ski according to claim 1, wherein one surface of said insert is self-adhesive.

3. A cross-country ski according to claim 1, wherein the lowest layer of the supporting body of the ski is made from a glass fiber reinforced plastic.

4. A cross-country ski according to claim 1, wherein said intermediate layer extends over only a part of the length of the ski.

5. A cross-country ski according to claim 4, wherein said intermediate layer extends over only a central portion of the ski.

6. A cross-country ski according to claim 4, wherein said intermediate layer has front and rear portions which are tapered in thickness.

7. A cross-country ski according to claim 4, wherein a plurality of recesses and corresponding inserts are provided, said intermediate layer extending over the total length of said recesses.

8. A cross-country ski according to claim 1, wherein said intermediate layer is made of polyethylene.

9. A cross-country ski according to claim 1, wherein said intermediate layer is made of an ABS-polymer.

* * * * *